US005576131A

United States Patent [19]

Takai et al.

[11] Patent Number: 5,576,131

[45] Date of Patent: Nov. 19, 1996

[54] ELECTROPHOTOGRAPHIC PHOTOSENSITIVE MEMBER, ELECTROPHOTOGRAPHIC APPARATUS INCLUDING SAME AND ELECTROPHOTOGRAPHIC APPARATUS UNIT

[75] Inventors: Hideyuki Takai; Koichi Suzuki, both of Yokohama; Satomi Sugiyama; Mitsuhiro Kunieda, both of Kawasaki, all of Japan

[73] Assignee: Canon Kabushiki Kaisha, Tokyo, Japan

[21] Appl. No.: 350,105

[22] Filed: Nov. 29, 1994

[30] Foreign Application Priority Data

Nov. 29, 1993 [JP] Japan ..... 5-320840

[51] Int. Cl.[6] ..... G03G 5/06

[52] U.S. Cl. ..... 430/59; 430/76; 430/78

[58] Field of Search ..... 430/58, 59, 76, 430/78

[56] References Cited

U.S. PATENT DOCUMENTS

| | | | |
|---|---|---|---|
| 4,664,977 | 5/1987 | Osato et al. | 428/336 |
| 4,728,592 | 3/1988 | Ohaku et al. | 430/59 |
| 4,994,338 | 2/1991 | Takai | 430/76 |
| 5,132,197 | 7/1992 | Iuchi et al. | 430/76 |
| 5,194,354 | 3/1993 | Takai et al. | 430/58 |
| 5,262,261 | 11/1993 | Kikuchi et al. | 430/59 |

FOREIGN PATENT DOCUMENTS

| | | |
|---|---|---|
| 0451844 | 10/1991 | European Pat. Off. . |
| 0487050 | 5/1992 | European Pat. Off. . |
| 61-239248 | 10/1986 | Japan . |
| 62-67094 | 3/1987 | Japan . |
| 3037665 | 2/1991 | Japan . |
| 3-37656 | 2/1991 | Japan . |
| 3-128973 | 5/1991 | Japan . |
| 3-200790 | 9/1991 | Japan . |

OTHER PUBLICATIONS

Abstract of JP 4–163558, published Jun. 1992.
Abstract of JP 5–66596, published Mar. 1993.
Patent Abstracts of Japan, vol. 15, No. 176 (P–1198), May 1991 of JP 3–037666.

*Primary Examiner*—John Goodrow
*Attorney, Agent, or Firm*—Fitzpatrick, Cella, Harper & Scinto

[57] ABSTRACT

An electrophotographic photosensitive member is constituted by disposing a photosensitive layer on a support. The photosensitive layer contains oxytitanium phthalocyanine and a specific disazo pigment of the formula (I) or (II) each characterized by having particular coupler residues. The photosensitive layer may preferably include a charge generation layer and a charge transport layer. The charge generation layer may preferably include a first charge generation layer containing the above disazo pigment of the formula (I) or (II) and a second charge generation layer containing the above oxytitanium phthalocyanine. The electrophotographic photosensitive member including the photosensitive layer described above is usable for providing an apparatus unit and an electrophotographic apparatus showing excellent electrophotographic characteristics such as high photosensitivity, good potential stability in repetitive use and good image-forming properties substantially providing no black spots.

20 Claims, 7 Drawing Sheets

ELECTROPHOTOGRAPHIC PHOTOSENSITIVE MEMBER, ELECTROPHOTOGRAPHIC APPARATUS INCLUDING SAME AND ELECTROPHOTOGRAPHIC APPARATUS UNIT

FIELD OF THE INVENTION AND RELATED ART

The present invention relates to an electrophotographic photosensitive (or electrophotosensitive) member, an electrophotographic apparatus including the photosensitive member and an electrophotographic apparatus unit including the photosensitive member.

In organic electrophotosensitive members comprising a photosensitive layer containing an organic photoconductor, there have been used so-called function separation-type electrophotosensitive members having a lamination structure of a charge generation layer containing a charge-generating material and a charge transport layer containing a charge-transporting material in many cases. The function separation-type electrophotosensitive members have provided remarkably improved electrophotographic characteristics such as a high sensitivity and an excellent durability, thus being widely put into practical use.

Particularly, in recent years, there have been widely popularized non-impact type printers utilizing electrophotography as a terminal printer instead of conventional impact-type printers. These printers are laser beam printers using lasers as a light source in general. As the light source, semiconductor lasers are generally used in view of cost, apparatus size, etc. Semiconductor lasers generally used at present have a relatively longer wavelength (i.e., emission wavelength: 780±20 nm), so that electrophotosensitive members having a sufficient sensitivity to laser light showing such a longer wavelength have been studied and developed.

There have been studied and proposed many charge-generating materials having a high sensitivity to long-wavelength light, among which phthalocyanine compounds such as non-metallic phthalocyanine, copper phthalocyanine and oxytitanium phthalocyanine (hereinbelow, abbreviated as "TiOPc").

Particularly, oxytitanium phthalocyanine (TiOPc) shows a very high photosensitive characteristic and has various crystal forms similar to in other phthalocyanine compounds. Further, electrophotographic characteristics of TiOPc vary depending upon a difference in crystal form, so that many types of TiOPcs having various crystal forms have been studied and proposed. Representative examples thereof may include: α-type TiOPc as disclosed in Japanese Laid-Open Patent Application (JP-A) 61-239248 (corr. to U.S. Pat. No. 4,728,592), β-type TiOPc as disclosed in JP-A 62-67094 (U.S. Pat. No. 4,664,977), I-type TiOPc as disclosed in JP-A 3-128973 and Y-type TiOPc as disclosed in JP-A 3-200790.

However, not all conventional electrophotosensitive members using TiOPc had satisfactory potential stability in repetitive use. In addition, the conventional electrophotosensitive member had a drawback such that black spots (i.e., a phenomenon of occurrence of black spot-like fogs on a white background) are liable to occur in an electrophotographic process using a reversal development system under high-temperature and high-humidity environmental condition. In order to remedy such drawbacks, there have been proposed some methods including a method of thinning a charge generation layer and a method of increasing a proportion of a binder resin to TiOPc in a charge generation layer. As a result, however, such methods have failed to remedy the drawbacks since the resultant electrophotosensitive member showed a poor photosensitivity.

In order to obtain a panchromatic photosensitive member applicable to an apparatus having both functions of a laser beam printer and a copying machine, there has been proposed a method of mixing a disazo pigment with TiOPc or of using a disazo pigment and TiOPc each in superposed (or laminated) layers as disclosed in JP-A 3-37656. However, the resultant photosensitive members using such methods have substantially failed to sufficiently improve the above-described drawbacks.

SUMMARY OF THE INVENTION

An object of the present invention is to provide an electrophotographic photosensitive member having high photosensitivity and excellent stability of electric potential in repetitive use and capable of providing good images substantially free from black spots even under high-temperature and high-humidity environmental condition.

Another object of the present invention is to provide an electrophotographic apparatus including the photosensitive member and provide an electrophotographic apparatus unit including the photosensitive member.

According to the present invention, there is provided an electrophotographic photosensitive member, comprising: a support and at least a photosensitive layer disposed on the support, wherein the photosensitive layer comprises oxytitanium phthalocyanine and a disazo pigment represented by the following formula (I):

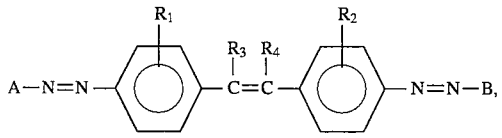

(I)

in which $R_1$ and $R_2$ independently denote hydrogen atom, halogen atom, alkyl group or alkoxy group;

$R_3$ and $R_4$ independently denote hydrogen atom, halogen atom or cyano group; and A and B independently denote a coupler residue represented by any one of the following groups (i) to (iv):

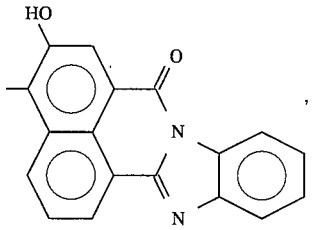

(i)

-continued (ii)

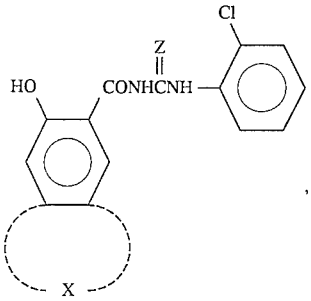

(iii)

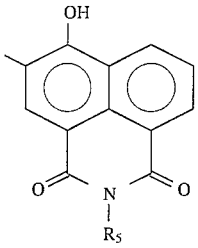

and (iv)

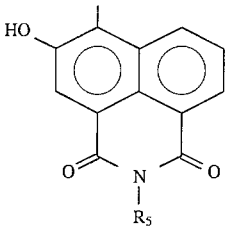

wherein $R_5$ denotes alkyl group or aryl group; X denotes a residual group for forming a substituted or unsubstituted polycyclic aromatic ring or a substituted or unsubstituted polycyclic heterocycle through condensation reaction with benzene ring; and Z denotes oxygen atom or sulfur atom.

According to the present invention, there is also provided an electrophotographic photosensitive member, comprising: a support and at least a photosensitive layer disposed on the support, wherein the photosensitive layer comprises oxytitanium phthalocyanine and a disazo pigment represented by the following formula (II):

(II)

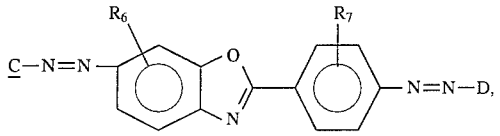

in which $R_6$ and $R_7$ independently denote hydrogen atom, halogen atom, alkyl group or alkoxy group; and C and D independently denote a coupler residue represented by any one of the following group (i) or (v):

(i)

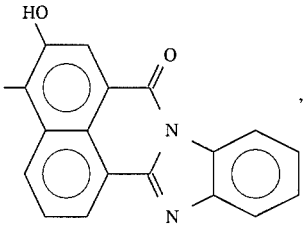

or

-continued (v)

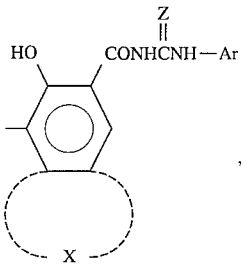

wherein X denotes a residual group for forming a substituted or unsubstituted polycyclic aromatic ring or a substituted or unsubstituted polycyclic heterocycle through condensation reaction with benzene ring; Z denotes oxygen atom or sulfur atom; and Ar denotes substituted or unsubstituted aryl group.

The present invention provides an electrophotographic apparatus, comprising: the electrophotographic photosensitive member as described above, a charging means for charging the electrophotographic photosensitive member, an image-exposure means for effecting image-exposure to the electrophotographic photosensitive member to form an electrostatic latent image, and a developing means for developing the electrostatic latent image with a toner.

The present invention further provides an electrophotographic apparatus unit, comprising: the electrophotographic photosensitive member as described above and a direct charging member contacting and charging the electrophotographic photosensitive member.

These and other objects, features and advantages of the present invention will become more apparent upon a consideration of the following description of the preferred embodiments of the present invention taken in conjunction with the accompanying drawings.

DETAILED DESCRIPTION OF THE INVENTION

Figure 1:
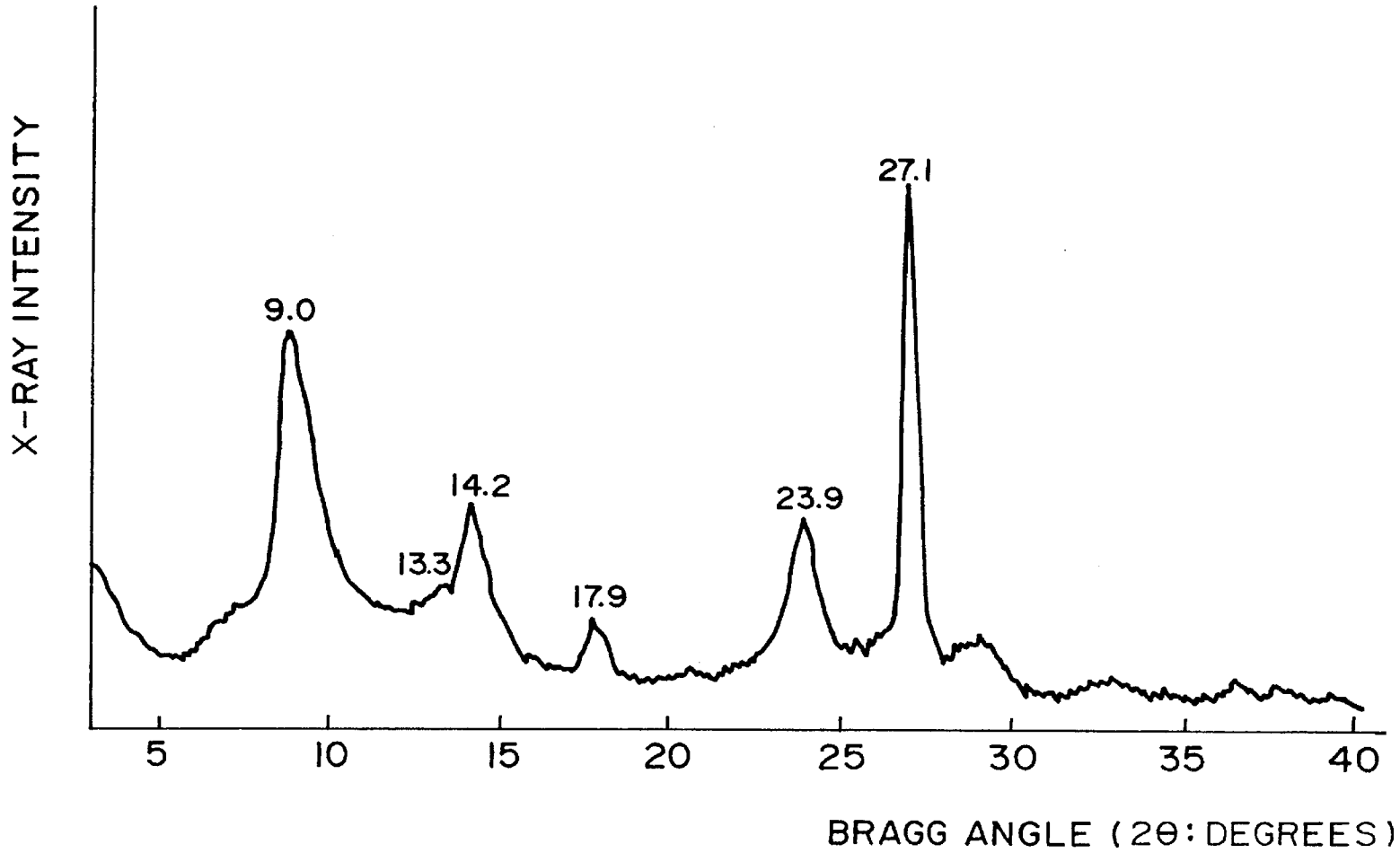
FIGS. 1–4 are graphs showing X-ray diffraction patterns of oxytitanium phthalocyanine of I-type, α-type, β-type and Y-type, respectively.

The electrophotographic photosensitive member according to the present invention is characterized by a photosensitive layer comprising TiOPC and a disazo pigment of the formula (I) or (II) each having a coupler residue.

Herein, the term "coupler residue" as A, B, C and D in the formula (I) and (II) means a group derived from a corresponding coupler (coupling component) by dropping any one hydrogen atom from a benzene ring constituting the coupler component. In the present invention, such a hydrogen atom may preferably be in the ortho position in respect to phenolic hydroxyl group.

In the formulae (I) and (II), preferred examples of halogen atom for $R_1$–$R_4$, $R_6$ and $R_7$ may include fluorine, chlorine and bromine.

Preferred examples of alkyl group for $R_1$, $R_2$, $R_5$, $R_6$ and $R_7$ may include methyl, ethyl, propyl and butyl.

Preferred examples of alkoxy group for $R_1$, $R_2$, $R_6$ and $R_7$ may include methoxy, ethoxy, propoxy and butoxy.

Preferred examples of the residual group for X in the groups (ii) and (v) may include those for forming naphthalene ring, anthracene ring, carbazole ring, benzocarbazole ring and dibenzocarbazole ring. The above polycyclic aromatic rings and polycyclic heterocycles may have a substituent, examples of which may include halogen atom such as fluorine, chlorine or bromine; alkyl group such as methyl, ethyl or propyl; alkoxy group such as methoxy, ethoxy or propoxy; nitro group; cyano group; and trifluoromethyl group.

Preferred examples of aryl group for $R_5$ and Ar may include phenyl, naphthyl and anthryl. Such an aryl group may have a substituent, examples of which may include those for the polycyclic aromatic rings and polycyclic heterocycles described above.

By incorporating the above-mentioned disazo pigment of the formula (I) or (II) in a photosensitive layer or a charge generation layer, it is possible to improve a potential stability in repetitive use or to prevent an occurrence of black spots without impairing a high photosensitive characteristic of TiOPc. Although the above disazo pigment of the formula (I) or (II) has no photosensitivity in the neighborhood of a wavelength of 800 nm, the photosensitivity of TiOPc to the wavelength of around 800 nm is sensitized by a chemically sensitizing action. As a result, it is possible to retain the high photosensitive characteristic of TiOPc even if an amount of TiOPC is decreased.

Preferred and specific examples of the disazo pigment of the formula (I) or (II) may include those shown by the following structural formulae, to which the disazo pigment of the formula (I) or (II) used in the present invention are however not restricted.

(Ex. Comp. No.)

(1)

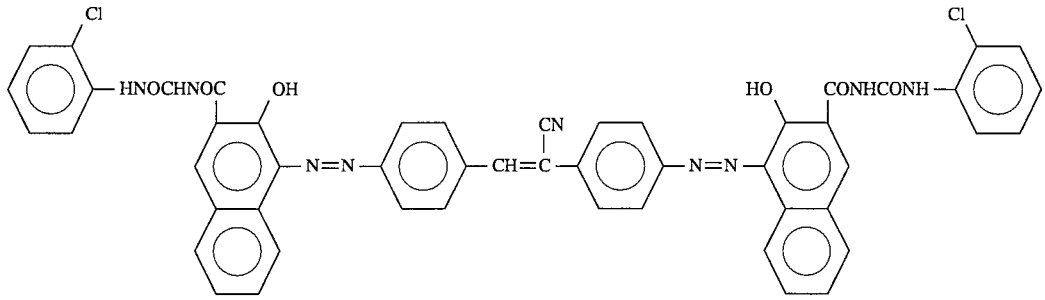

(2)

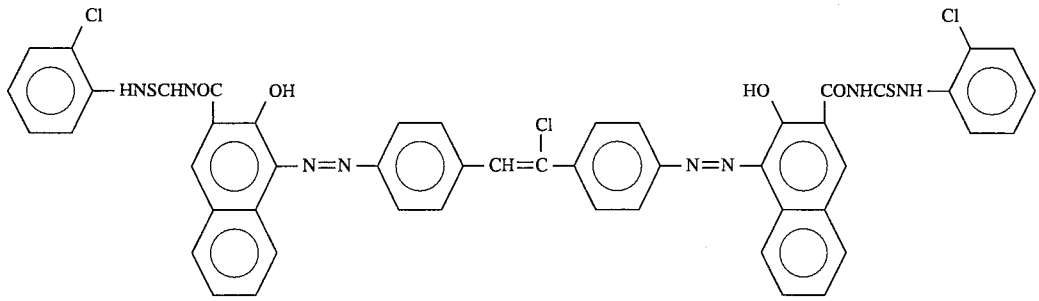

(3)

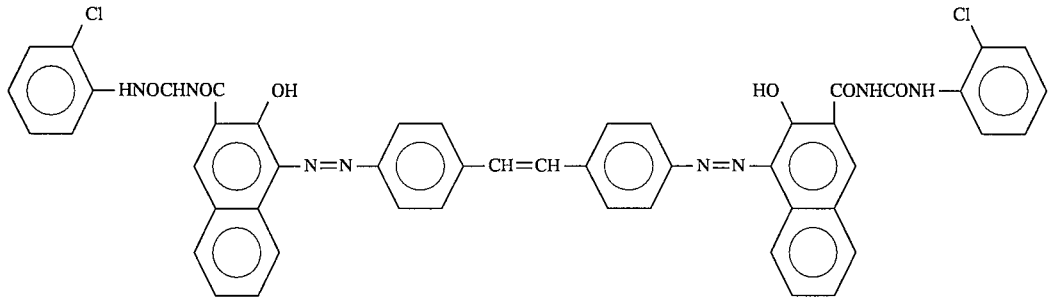

(4)

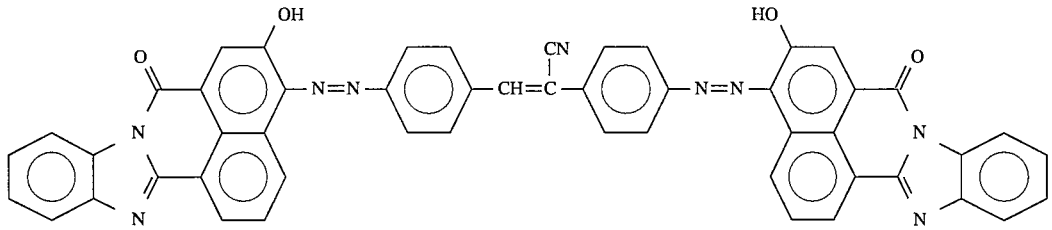

-continued
(Ex. Comp. No.)
(5)
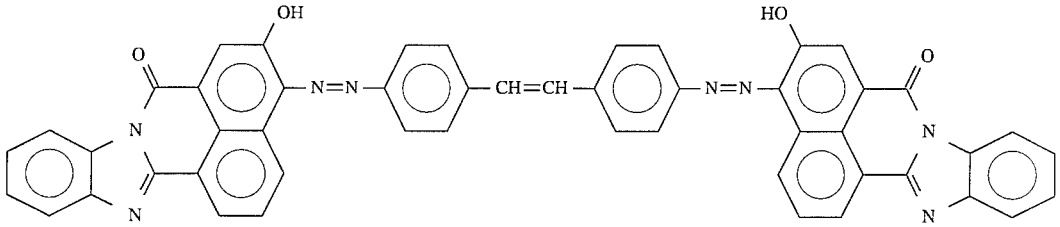
(6)
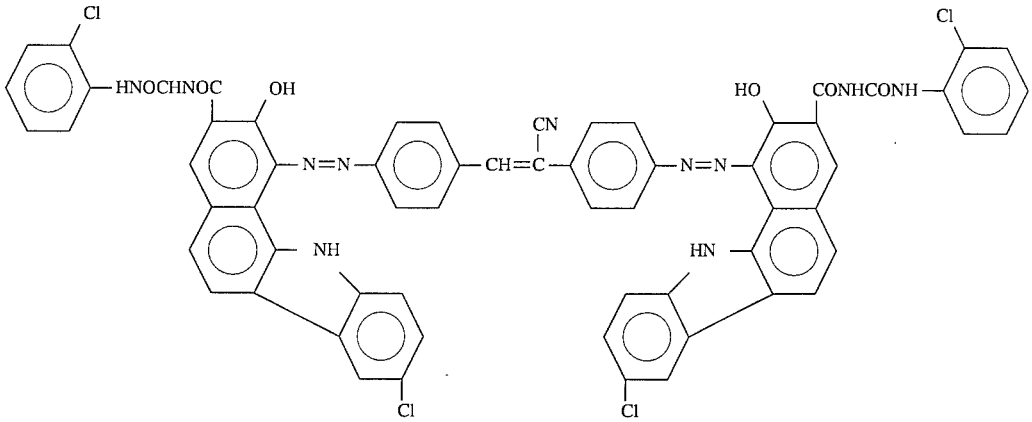
(7)
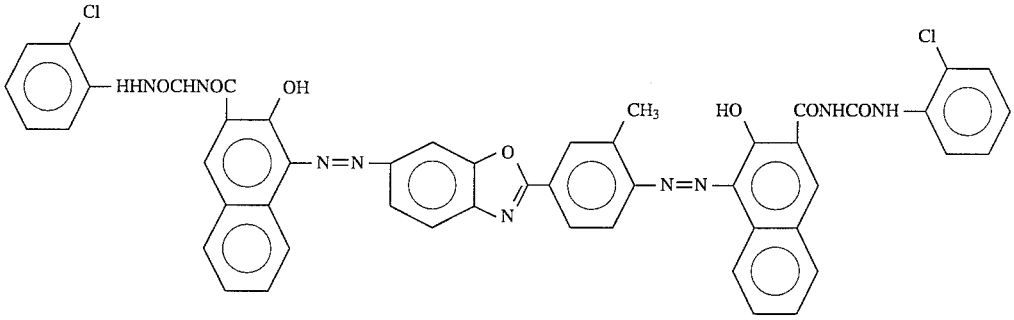
(8)
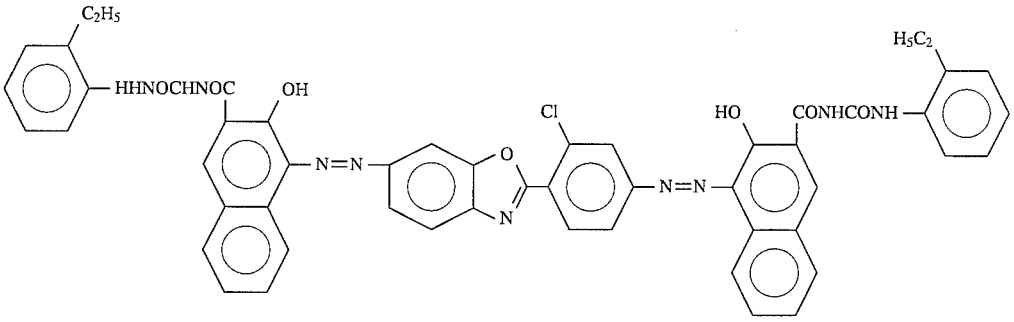
(9)
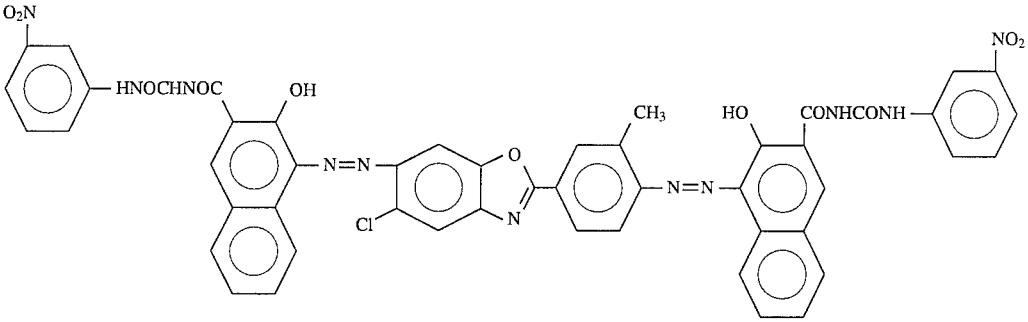

-continued
(Ex. Comp. No.)
(10)
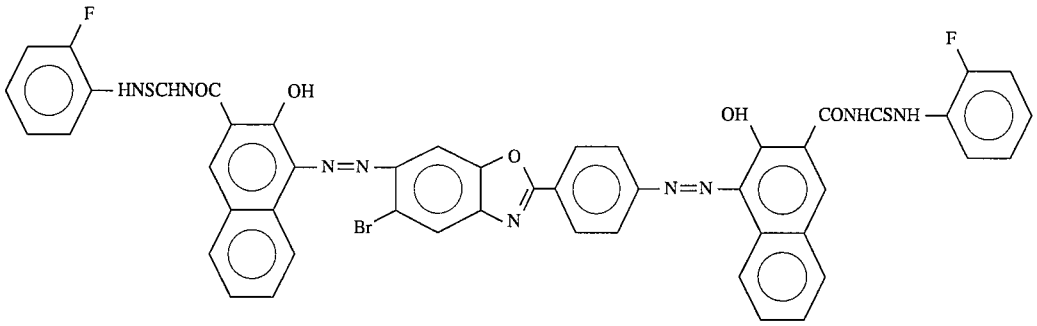
(11)
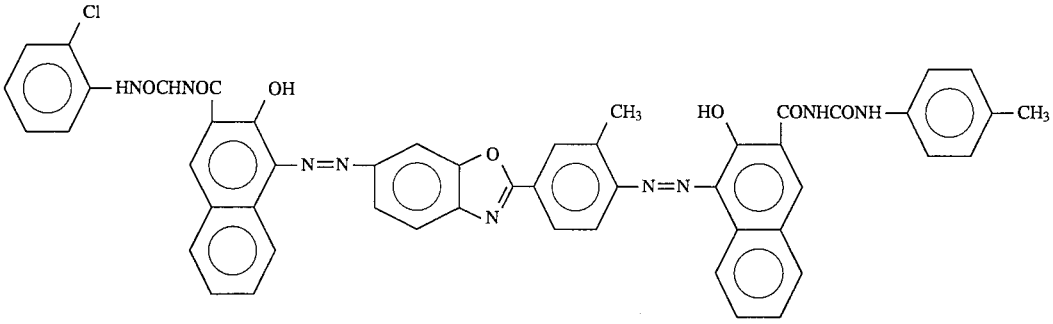
(12)
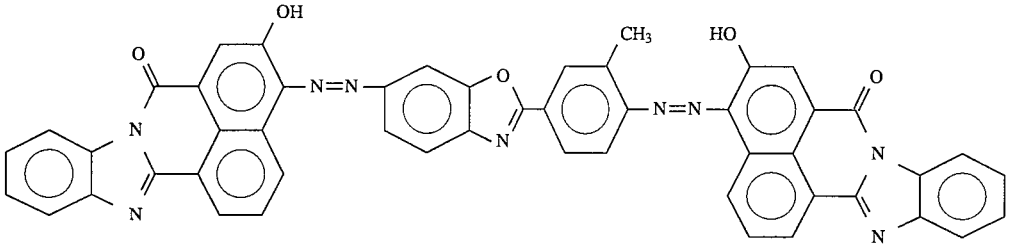
(13)
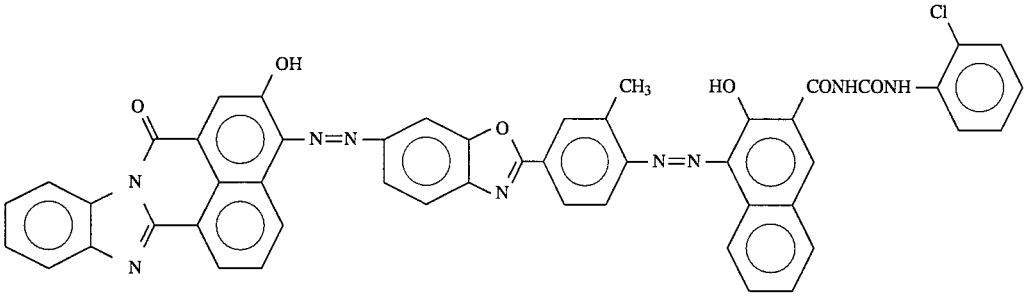

-continued (Ex. Comp. No.)

(14)

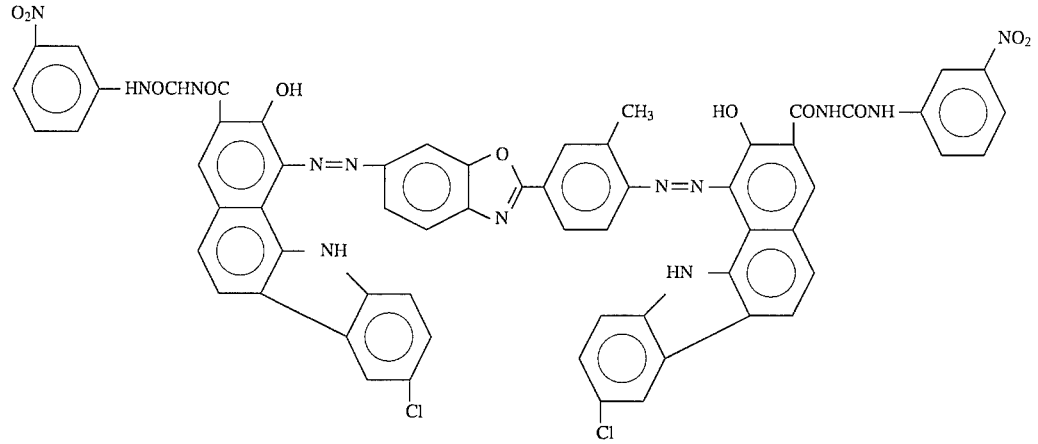

(15)

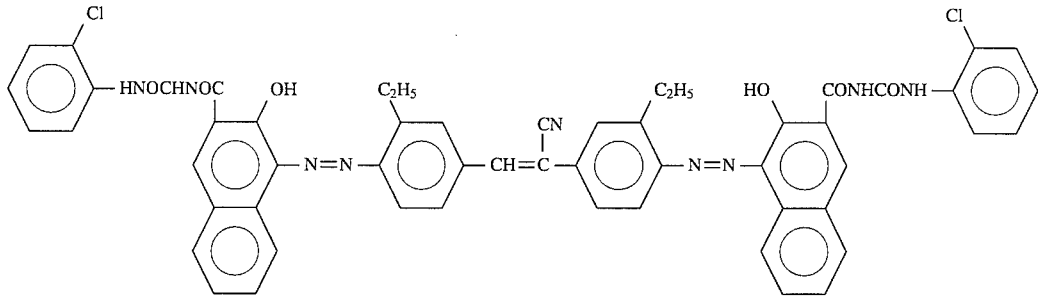

(16)

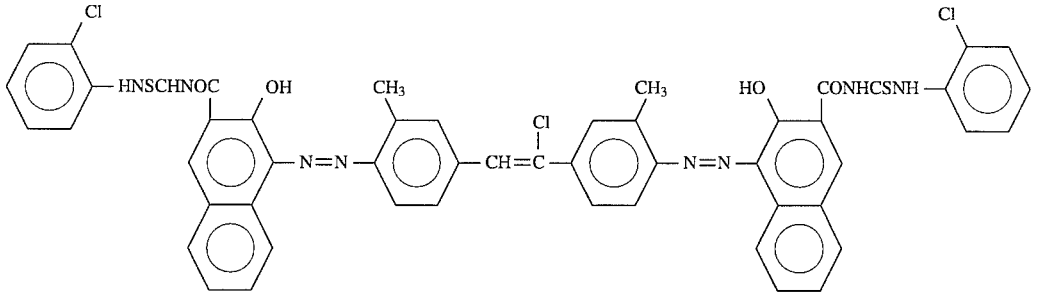

(17)

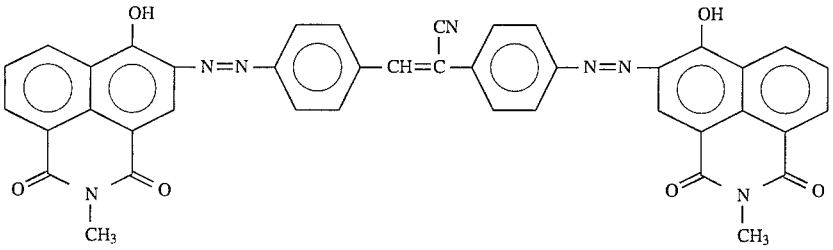

(18)

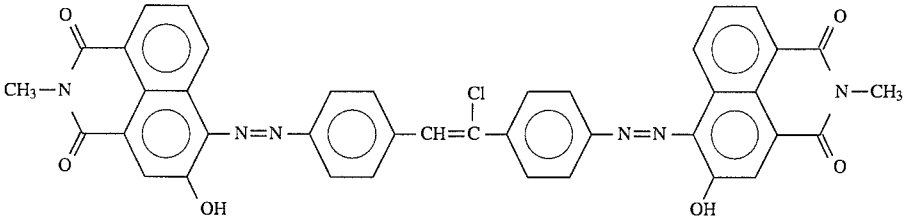

The disazo pigments of the formula (I) and (II) used in the present invention described above may generally be synthesized through a process wherein a corresponding diamine is tetrazotized according to an ordinary method (i.e., tetrazotization reaction) and the resultant tetrazonium salt is reacted with a corresponding coupler in the presence of alkali and aqueous medium (i.e., coupling reaction) or a process wherein a tetrazonium salt as obtained above is once converted or modified into a corresponding borofluoride salt or a double salt comprising the tetrazonium salt and zinc chloride and the resultant salt is reacted or coupled with a corresponding coupler in a solvent such as N,N-dimethylformamide (DMF) or dimethyl sulfoxide (DMSO) in the presence of a basic substance such as sodium acetate, triethylamine or N-methylmorpholine.

Alternatively, the structural formula of TiOPc (oxytitanium phthalocyanine) used in the present invention is represented by the following formula:

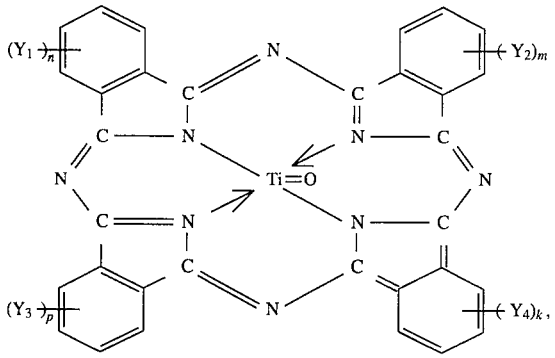

wherein $Y_1$, $Y_2$, $Y_3$ and $Y_4$ respectively denote Cl or Br; and n, m, k and p are respectively an integer of 0–4.

The TiOPc used in the present invention may have any crystal form. In the present invention, the TiOPc may preferably be α-type TiOPc, β-type TiOPc, I-type TiOPc or Y-type TiOPc, particularly I-type TiOPc.

The I-type TiOPc has a crystal form characterized by at least four main peaks specified by Bragg angles (2θ±0.2 degree) of 9.0 degrees, 14.2 degrees, 23.9 degrees and 27.1 degrees in X-ray diffraction pattern based on CuKα characteristic X-ray. The I-type TiOPc may preferably show a X-ray diffraction pattern as shown in FIG. 1.

Figure 2:
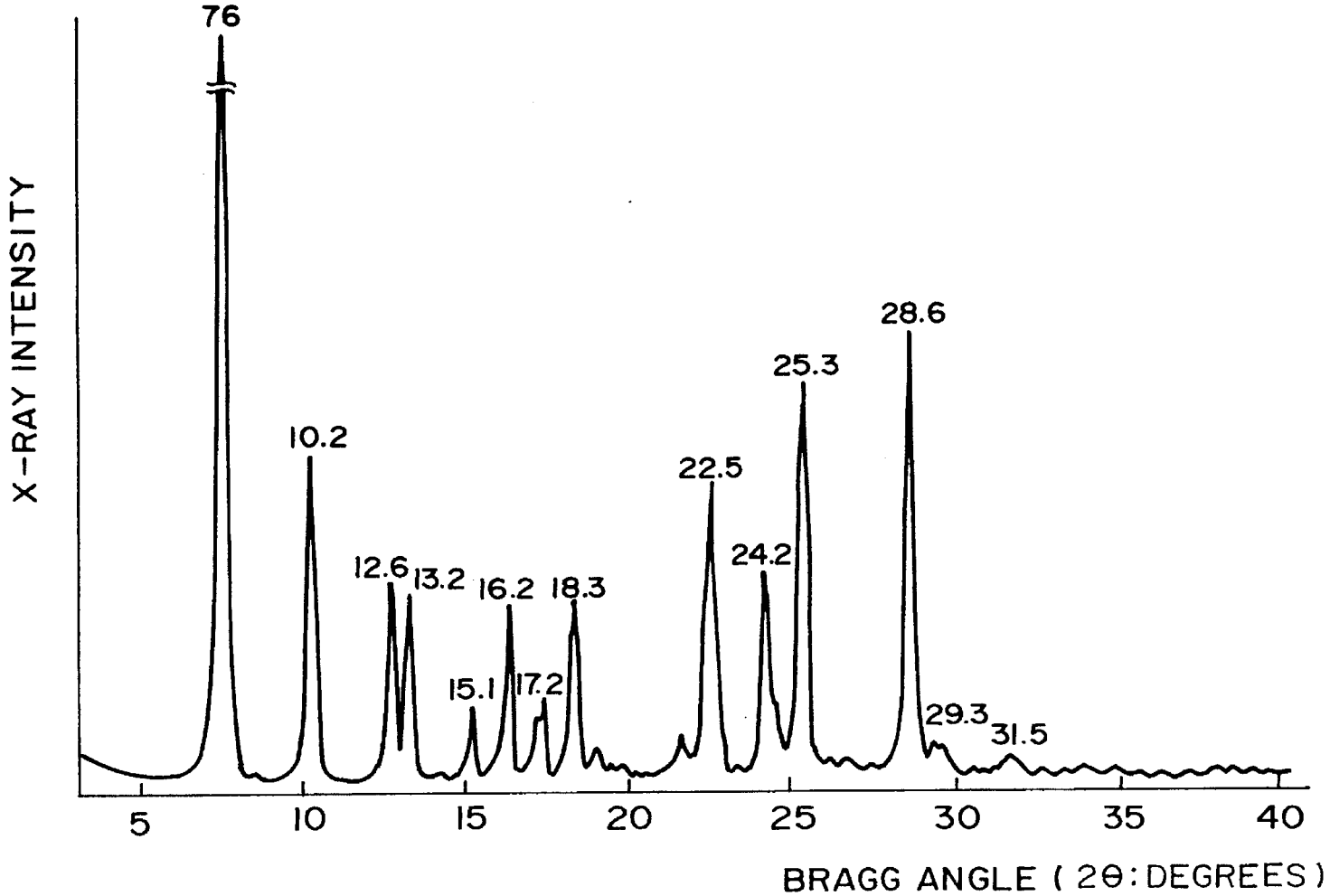

The α-type TiOPc has a crystal form characterized by at least two main peaks specified by Bragg angles (2θ±0.2 degree) of 7.6 degrees and 28.6 degrees in X-ray diffraction patter based on CuKα characteristic X-ray as preferably shown in FIG. 2.

Figure 3:
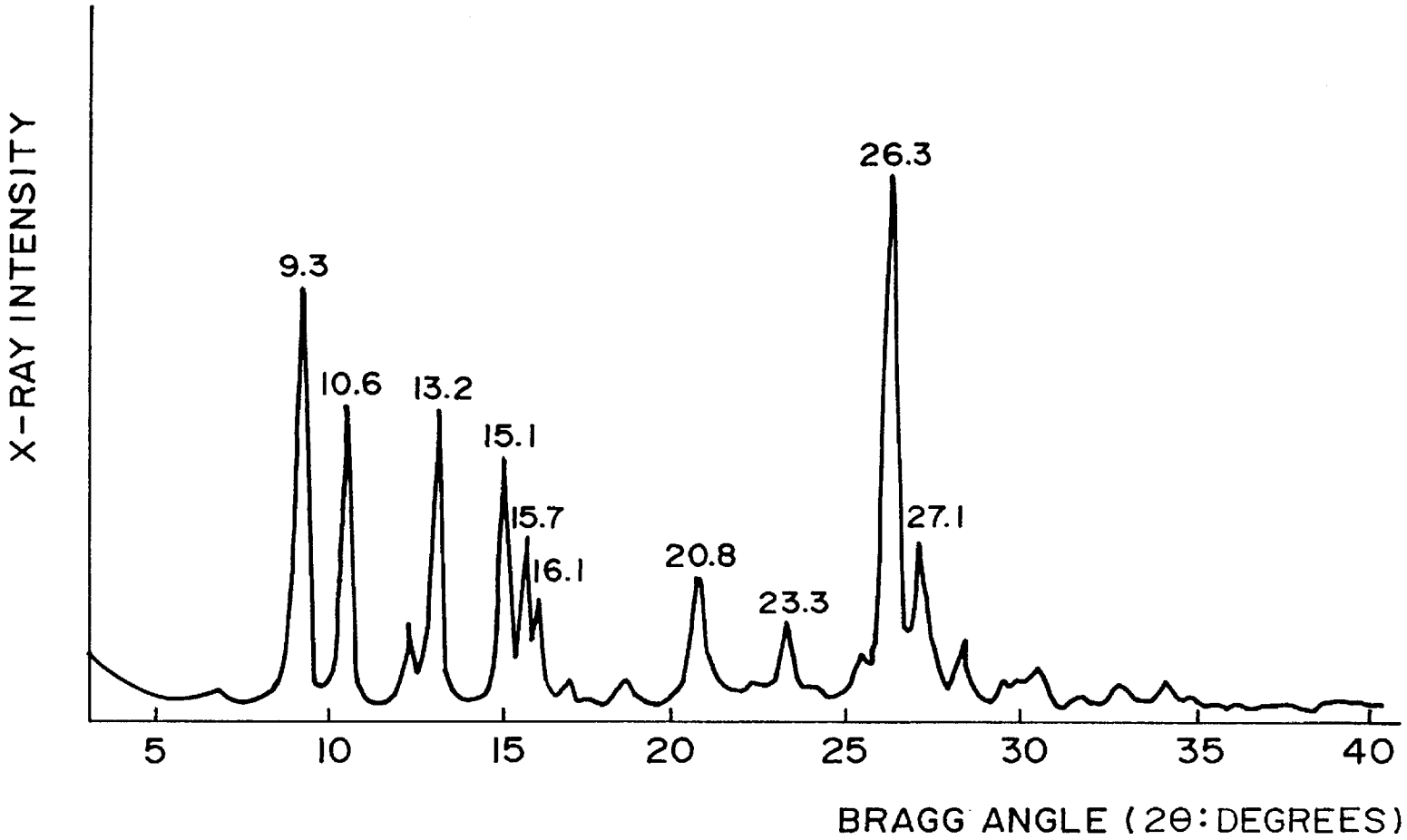

The β-type TiOPc has a crystal form characterized by at least two main peaks specified by Bragg angles (2θ±0.2 degree) of 9.3 degrees and 26.3 degrees in X-ray diffraction patter based on CuKα characteristic X-ray as preferably shown in FIG. 3.

Figure 4:
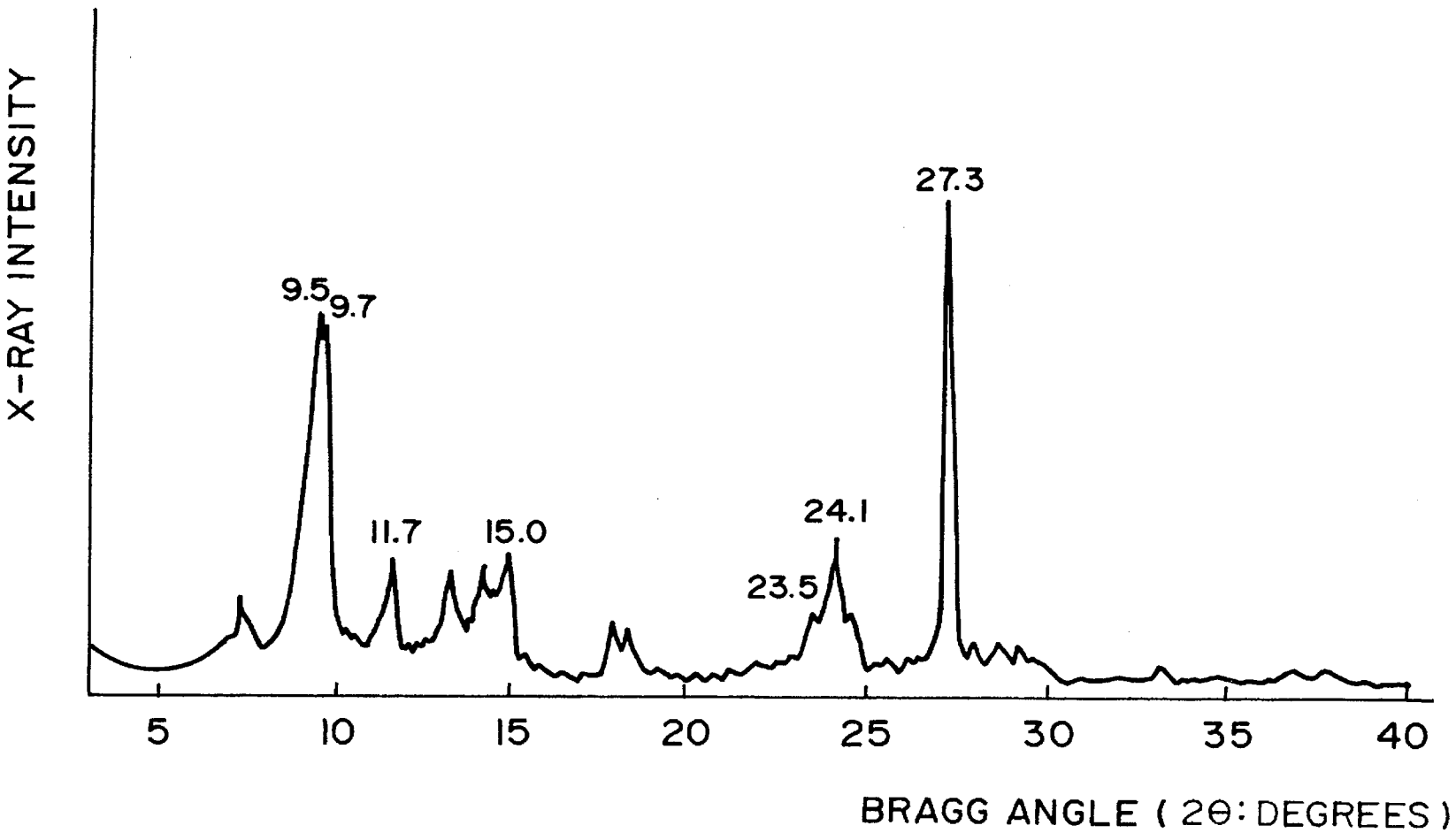

The Y-type TiOPc has a crystal form characterized by at least two main peaks specified by Bragg angles (2θ±0.2 degree) of 9.5 degrees and 27.3 degrees in X-ray diffraction patter based on CuKα characteristic X-ray as preferably shown in FIG. 4.

TiOPc (including those of I-type, α-type, β-type and Y-type) used in the present invention may generally be prepared according to processes as described in, e.g., JP-A Nos. 61-239248, 62-67094, 3-128973, 3-200790, 3-37656, etc.

Herein, the conditions of the X-ray diffraction analysis using CuK characteristic X-rays were as follows:

Measuring machine: X-ray diffraction apparatus (RAD-A system; manufactured by Rigaku Denki K. K.)
X-ray tube (Target): Cu
Tube voltage: 50 KV
Tube current: 40 mA
Scanning method: 2θ/θ scan
Scanning speed: 2 deg./min.
Sampling width: 0.020 deg.
Starting angle (2θ): 3 deg.
Stopping angle (2θ): 40 deg.
Divergence slit: 0.5 deg.
Scattering slit: 0.5 deg.
Receiving slit: 0.3 mm
Curved monochromator: used.

Figure 5:
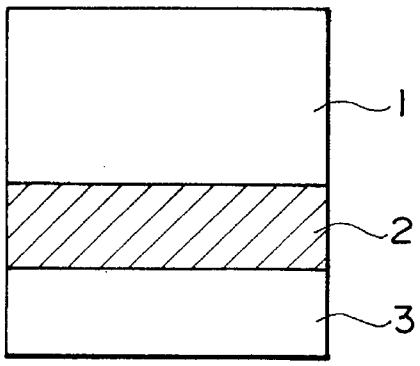
FIGS. 5–10 are schematic sectional views of laminar structures of electrophotosensitive members of the present invention.
Figure 6:
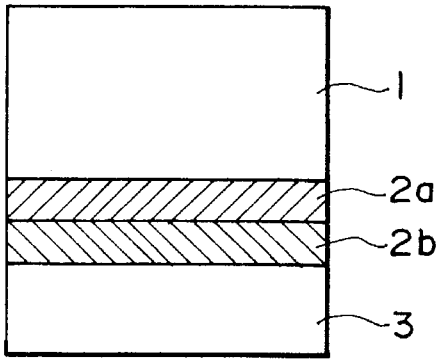
Figure 7:
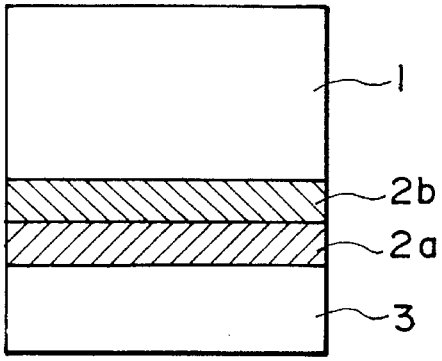
Figure 8:
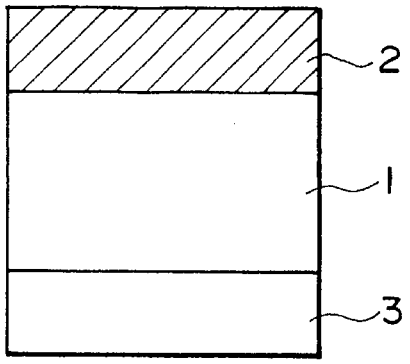
Figure 9:
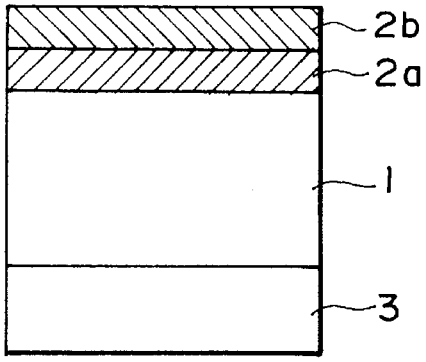
Figure 10:
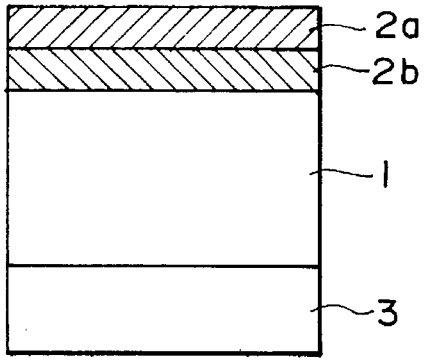

The photosensitive layer constituting the electrophotographic photosensitive member according to the present invention may have a layer structure comprising a single layer or a laminated layer. The layer structure of the photosensitive layer used in the present invention may preferably be a laminated (or lamination) layer structure as shown in FIG. 5 in which a charge generation layer 2 and a charge transport layer 1 are successively disposed on a support 3. As shown in FIG. 8, it is also possible to dispose a charge transport layer 1 and a charge generation layer in sequence on a support 3. Further, as shown in FIGS. 6, 7, 9 and 10, the charge generation layer 2 may be divided into a first charge generation layer **2*a* containing a disazo pigment of the formula (I) or (II) and a second charge generation layer 2*b* containing TiOPc. In this instance, the charge transport layer 1 may be caused to be in contact with the first charge generation layer 2*a* containing the disazo pigment of the formula (I) or (II) as shown in FIGS. 6 and 9 or the second charge generation layer 2*b* containing the TiOPc as shown in FIGS. 7 and 10. The layer structure in which the charge transport layer 1 is in contact with the second charge generation layer 2*b* gives better results. In the above layer structures, the boundary between the first charge generation layer 2*a* and the second charge generation layer 2*b*** may be unclear.

In case where the photosensitive layer has the single layer structure, the photosensitive layer may generally be prepared by mixing TiOPc, the disazo pigment of the formula (I) or (II), a charge-transporting material and a binder resin in an appropriate solvent and applying the resultant mixture (coating liquid) onto a support by ordinary coating methods, followed by drying the resultant coating.

In the case where the photosensitive layer has the lamination structure comprising a charge generation layer and a charge transport layer, the charge generation layer may generally be prepared by mixing either one or both of TiOPc and the disazo pigment of the formula (I) or (II) together with a binder resin in an appropriate solvent and applying the resultant mixture by ordinary coating method, followed by drying the resultant coating. The charge transport layer may be prepared in the same manner as in the case of the charge generation layer except for mixing a charge-transporting material instead of the above charge-generating materials.

Examples of the charge-transporting material used in the present invention may include: triarylamine compounds, hydrazone compounds, stilbene compounds, pyrazoline compounds, oxazole compounds, thiazole compounds and triaryl methane compounds.

Examples of the binder resin used in the photosensitive layer may include: polyester, acrylic resins, polyvinylcarbazole, phenoxy resins, polycarbonate, polyvinyl butyral, polystyrene, vinyl acetate resins, polysulfone, polyarylate and vinylidene chloride-acrylonitrile copolymers.

The coating method used for forming the respective layers may include: dipping, spray coating, spinner coating, roller coating, wire bar coating and blade coating.

In the case where the photosensitive layer used in the present invention is composed of a single layer (single layer-type photosensitive layer), TiOPc and the disazo pigment of the formula (I) or (II) as a charge-generating material may preferably be contained in the photosensitive layer in a total amount of 3–30 wt. %. A mixing ratio (by weight) of (TiOPc)/(disazo pigment) may preferably be 20/1 to 3/7, more preferably be 15/1 to 4/6, particularly be above 1/1. The charge-transporting material may preferably be contained in the photosensitive layer in an amount of 30–70 wt. %.

In case where the photosensitive layer used in the present invention is composed of a lamination layer of the charge generation layer and the charge transport layer (lamination layer-type photosensitive layer), TiOPc and the disazo pigment of the formula (I) or (II) may preferably be contained in the charge generation layer in a total amount of 20–80 wt. %, particularly 30–70 wt. % when the TiOPc and the disazo pigment are contained in the charge generation layer having a single layer structure. In this instance, a mixing ratio of (TiOPc)/(disazo pigment) may preferably be the same ratios as in the case of the single layer-type photosensitive layer described above. When the disazo pigment and the TiOPc are separately contained in the first charge operation layer and the second charge generation layer, respectively, the disazo pigment may preferably be contained in the first charge generation layer in an amount of 20–80 wt. %, particularly 30–70 wt. % and the TiOPc may preferably be contained in the second charge generation layer in an amount of 20–80 wt. %, particularly 30–70 wt. %. The charge-transporting material may preferably be contained in the charge transport layer in an amount of 30–70 wt. %.

The single layer-type photosensitive layer may preferably have a thickness of 5–50 μm, more preferably 10–40 μm.

In the lamination layer-type photosensitive layer, the charge generation layer may preferably have a thickness of 0.05–1.0 μm, particularly 0.1–0.5 μm, and the charge transport layer may preferably have a thickness of 5–50 μm, particularly 8–20 μm. The first charge generation layer containing the disazo pigment of the formula (I) or (II) may preferably have a thickness of 0.05–0.2 μm and the second charge generation layer containing the TiOPc may preferably have a thickness of 0.05–1.0 μm, particularly 0.1–0.5 μm.

The support used in the present invention may preferably be composed of an electroconductive material such as aluminum, aluminum alloy or stainless steel or composed of a material such as plastic, paper or metal on which an electroconductive surface layer is formed. The electroconductive surface layer may preferably be formed by vacuum vapor deposition of aluminum, aluminum alloy or indium oxide—tin oxide alloy or by mixing electroconductive particles, such as carbon black and tin oxide particles, with a binder and then applying the mixture. The electroconductive surface layer may preferably have a thickness of 1–30 μm. The support used in the present invention may preferably be formed in a cylindrical shape or a film (or sheet) shape.

In the present invention, it is possible to dispose an undercoat (or primer) layer having a barrier function and an adhesive function, as desired, between the support (or the electroconductive surface layer) and the photosensitive layer. The undercoat layer may comprise casein, polyvinyl alcohol, nitro cellulose, ethylene-acrylic acid (or acrylate) copolymer, polyamide, modified polyamide, polyurethane, gelatin, aluminum oxide. The undercoat layer may preferably have a thickness of at most 5 μm, particularly 0.5–3 μm. The undercoat layer may desirably have a resistivity of at least $10^7$ Ω.cm.

Between the support (or the electroconductive surface layer) and the undercoat layer, an electroconductive layer may suitably be formed, as desired, in order to cover defects on the support and/or prevent interference fringes due to scattering of laser light in the case where laser light is used for inputting image data. The electroconductive layer can be formed by dispersing electroconductive powder, such as carbon black, metal particles or metal oxide particles, in a binder resin and then applying the dispersion. The electroconductive layer may preferably have a thickness of 5–40 μm, particularly 10–30 μm.

On the photosensitive layer, it is possible to dispose a protective layer, as desired. The protective layer may comprise a resin such as polyvinyl butyral, polyester, polycarbonate (e.g., polycarbonate Z or modified polycarbonate), nylon, polyimide, polyarylate, polyurethane, styrene-butadiene copolymer, styrene-acrylic acid (or acrylate) copolymer, styrene-acrylonitrile copolymer. The protective layer can be formed by dissolving such a resin in an appropriate organic solvent and applying the solution or the photosensitive layer, followed by drying. The protective layer may preferably have a thickness of 0.05–20 μm. The protective layer may further contain electroconductive particles, such as metal oxide particles (e.g., tin oxide particles), or an ultraviolet light absorber.

Figure 11:
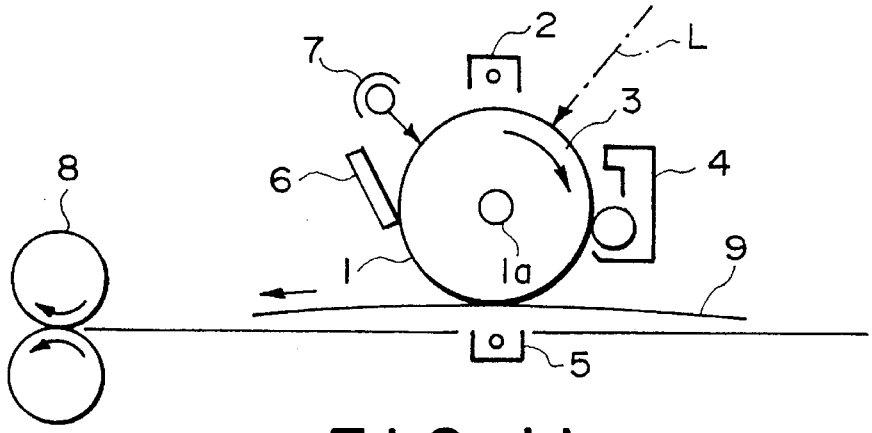
FIGS. 11–13 are schematic structural views showing embodiment of electrophotographic apparatus using the electrophotosensitive member according to the present invention.

FIG. 11 shows a schematic structural view of an ordinary transfer-type electrophotographic apparatus using an electrophotosensitive member of the invention. Referring to FIG. 11, a photosensitive drum (i.e., photosensitive member) 1 is rotated about an axis 1*a* at a prescribed peripheral speed in the direction of the arrow shown inside of the photosensitive drum 1. The surface of the photosensitive drum is uniformly charged by means of a charger (charging means) 2 to have a prescribed positive or negative potential. The photosensitive drum 1 is exposed to light-image L (as by slit exposure or laser beam-scanning exposure) by using an image-exposure means (not shown), whereby an electrostatic latent image corresponding to an exposure image is successively formed on the surface of the photosensitive drum 1. The electrostatic latent image is developed with a toner by a developing means 4 to form a toner image. The toner image is successively transferred to a recording material 9 which is supplied from a supply part (not shown) to a position between the photosensitive drum 1 and a transfer corona charger (transfer means) 5 in synchronism with the rotating speed of the photosensitive drum 1, by means of the transfer corona charger 5. The recording material 9 with the toner image thereon is separated from the photosensitive drum 1 to be conveyed to an image-fixing device (image-fixing means) 8, followed by image fixing to print out the recording material 9 as a copy product outside the electrophotographic apparatus. Residual toner particles on the surface of the photosensitive drum 1 after the transfer are removed by means of a cleaner (cleaning means) 6 to provide a cleaned surface, and residual charge on the surface of the photosensitive drum 1 is erased by a pre-exposure means 7 to prepare for the next cycle. As the charger 2 for charging the photosensitive drum 1 uniformly, a corona charger is widely used in general.

Figure 12:
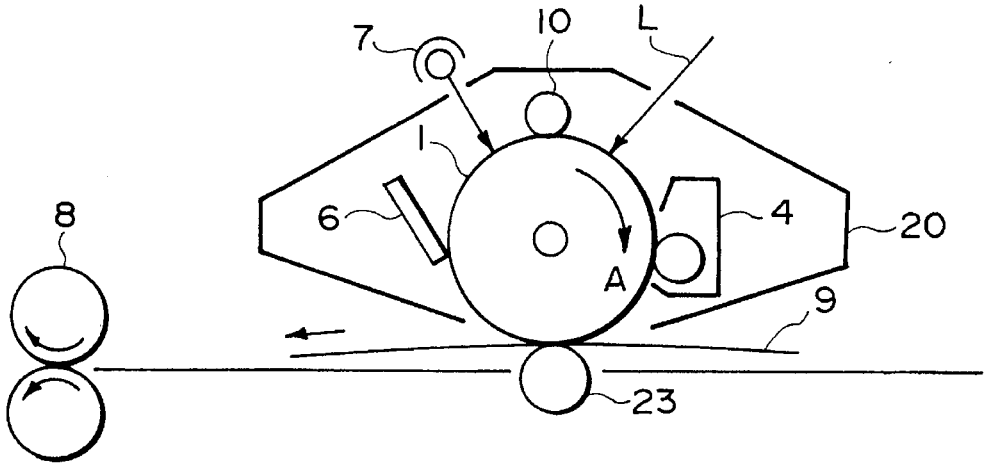
Figure 13:
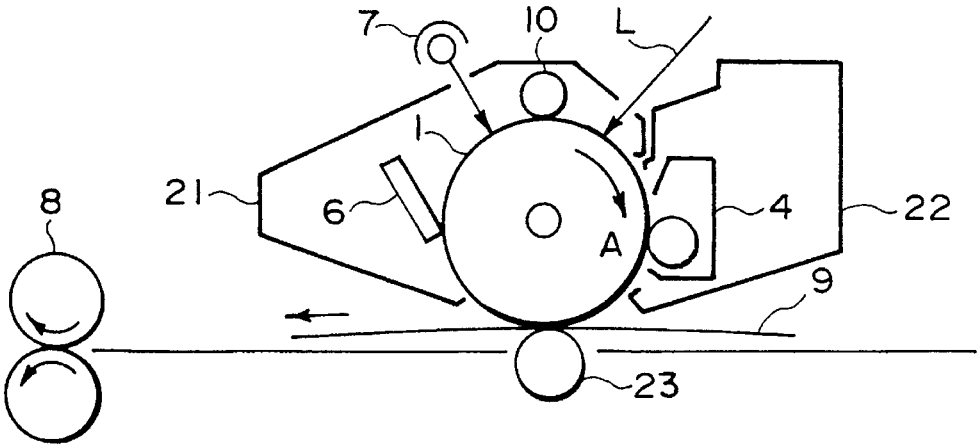

In FIGS. 12 and 13, a direct charging means 10 as a charging means is used for directly charging the photosensitive drum (member) 1. Specifically, the direct charging means 10 supplied with a voltage is caused to be in contact with the photosensitive member 1 directly to effect direct charging of the photosensitive member 1. In the apparatus as shown in FIGS. 12 and 13, toner images formed on the photosensitive member 1 are transferred to a recording member 9 by a direct charging member 23. Specifically, a voltage-applied direct charging member 23 is caused to be in contact with the recording member 9 directly, thus transferring the toner images formed on the photosensitive member 1 onto the recording material 9. In FIGS. 12 and 13, the respective reference numerals means the same members as those described above (in FIG. 11).

In the electrophotographic apparatus shown in FIG. 12, at least three members comprising a photosensitive member 1, a direct charging member 10 and a developing means 4 are integrally supported to form a single unit (electrophotographic apparatus unit), such as a container or process cartridge 20, being attachable to or detachable from an apparatus body by using a guiding means such as a rail within the apparatus body. In this case, a cleaning means 6 may be disposed in the container 20.

In the electrophotographic apparatus shown in FIG. 13, a first electrophotographic apparatus unit comprising at least two members of a photosensitive member 1 and a direct charging member 10 installed in a container 21 and a second electrophotographic apparatus unit comprising at least a developing means 7 installed in a container 22 are disposed attachably to or detachably from an apparatus body. In this case, a cleaning means 6 may be disposed in the container 21.

In a case where the electrophotographic apparatus is used as a copying machine or a printer, exposure light-image L may be given by using reflection light or transmitted light from an original or by reading data on the original, converting the data into a signal and then effecting a laser beam scanning, a drive of LED array or a drive of a liquid crystal shutter array.

The electrophotographic photosensitive member according to the present invention can be applied to not only an ordinary electrophotographic copying machine but also a facsimile machine, a laser beam printer, a light-emitting diode (LED) printer, a cathode-ray tube (CRT) printer, a liquid crystal printer, and other fields of applied electrophotography including, e.g., laser plate making.

Hereinbelow, the present invention will be explained more specifically with reference to examples. In the following examples, a term "part(s)" means "weight part(s)".

EXAMPLE 1

50 parts of titanium oxide powder coated with tin oxide containing 10% of antimony oxide, 25 parts of a resol-type phenolic resin, 20 parts of ethylene glycol monomethyl ether (methyl cellosolve), 5 parts of ethanol and 0.002 part of a silicone oil (polydimethylsiloxane-polyoxyalkylene copolymer; average molecular weight=3,000) were mixed and dispersed for 2 hours in a sand mill using 1 mm ϕ-glass beads to prepare a coating liquid for an electroconductive layer. The coating liquid was applied onto a peripheral surface of an aluminum cylinder (outer diameter=80 mm, length=360 mm) by dipping and then dried at 140° C. for 30 minutes to form a 20 μm-thick electroconductive layer.

Onto the electroconductive layer, a solution of 5 parts of 6-66-610-12 quaternary polyamide copolymer ("Amilan CM8000", manufactured by Toray K. K.) in a mixture solvent of 70 parts of methanol and 25 parts of butanol was applied by dipping, followed by drying to form a 1 μm-thick undercoat layer.

Then, 6 parts of I-type oxytitanium phthalocyanine (I-type TiOPc) having a X-ray diffraction pattern as shown in FIG. 1 and 4 parts of a disazo pigment of the formula (I) (Ex. Comp. No. (1)) were added to a solution of 10 parts of polyvinyl butyral ("S-LEC BX-1", mfd. by Sekisui Kagaku Kogyo K. K.) in 400 parts of cyclohexanone and was dispersed for 3 hours in a sand mill using 1 mmϕ-glass beads. To the dispersion, 400 parts of ethyl acetate was added, thus preparing a coating liquid for a charge generation layer. The coating liquid was applied onto the undercoat layer by dip coating and dried for 10 minutes at 80° C. to form a 0.25 μm-thick charge generation layer.

10 parts of a charge-transporting material of the formula:

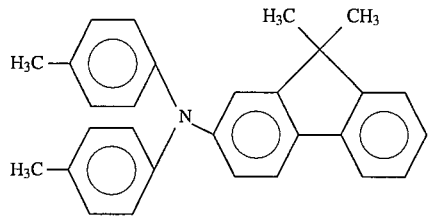

and 10 parts of a bisphenol Z-type polycarbonate resin were dissolved in 60 parts of chlorobenzene to prepare a coating liquid for a charge transport layer. The coating liquid was applied onto the above charge generation layer by dip coating and dried for 1 hour at 110° C. to form a 20 μm-thick charge transport layer, thus preparing an electrophotosensitive member according to the present invention.

Comparative Example 1

An electrophotographic photosensitive member was prepared in the same manner as in Example 1 except that 10 parts of I-type TiOPc was used and no disazo pigment (Ex. Comp. No. (1)) was used.

Comparative Example 2

An electrophotographic photosensitive member was prepared in the same manner as in Example 1 except for omitting the disazo pigment (Ex. Comp. No. (1)).

Comparative Example 3

An electrophotographic photosensitive member was prepared in the same manner as in Example 1 except that the disazo pigment (Ex. Comp. No. (1)) was changed to a disazo pigment of the formula:

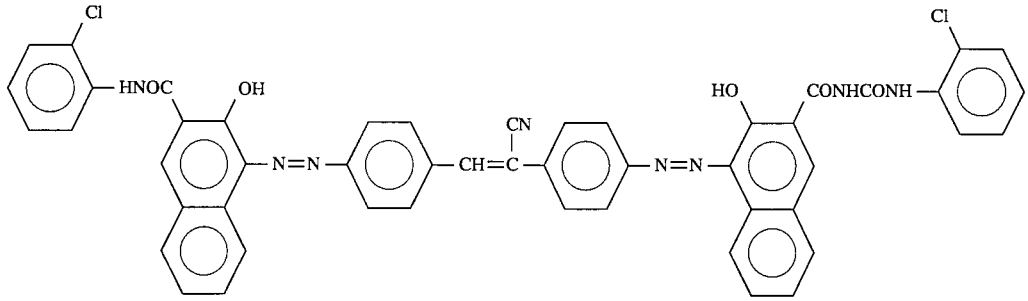

Each of the photosensitive members prepared in Example 1 and Comparative Examples 1–3 was installed in a laser beam printer ("LBP-SX", mfd. by Canon K. K.). The photosensitive member was charged so as to have a dark part potential of −700 V and then exposed to laser light (emission wavelength: 802 nm) so as to have a light part potential of −150 V. At this time, a laser light quantity (μJ/cm$^2$) required for decreasing the potential from −700 V to −150 V was measured to evaluate the photosensitivity. Further, the thus prepared laser beam printer was subjected to a successive copying test of 5000 sheets. At this time, dark part potentials at an initial stage and after the copying test and light part potentials at an initial stage and after the copying test were measured, whereby a fluctuation in these dark part potentials ($\Delta V_D$) and a fluctuation in these light part potentials ($\Delta V_L$) were obtained to evaluate a potential stability in repetitive use. The laser beam printer was further subjected to image formation providing an entire white image under high-temperature (35° C.) and high-humidity (90%) environmental condition to observe a state of occurrence of black spots.

The results are shown in Tables 1 and 2.

TABLE 1

| Ex. No. | Weight ratio (TiOPc)/(disazo pigment) | Weight ratio (CGM*)/(Binder resin) |
|---|---|---|
| Ex. 1 | 6/4 | 10/10 |
| Comp. Ex. | | |
| 1 | 10/0 | 10/10 |
| 2 | 6/0 | 6/10 |
| 3 | 6/4 | 10/10 |

*: Charge-generation material (TiOPc + disazo pigment).

TABLE 2

| Ex. No. | Sensitivity (μJ/cm$^2$) | Fluctuation in potential $\Delta V_D$ (V) | Fluctuation in potential $\Delta V_L$ (V) | Black spots* |
|---|---|---|---|---|
| Ex. 1 | 0.22 | 0 | +10 | 0 |
| Comp. Ex. | | | | |
| 1 | 0.22 | −40 | −20 | 3 |
| 2 | 0.30 | −30 | −15 | 2 |
| 3 | 0.30 | −20 | +40 | 3 |

*: Black spots were evaluated herein by comparing a test sample with standard samples classified into 6 ranks (0 to 5).

The rank "0" denotes no black spots and the rank "5" denotes a state in which black spots occur over the entire image region to assume gray. Thus, the larger number of the ranks gives a higher frequency of occurrence of black spots and the ranks "0" to "2" are an acceptable level.

As apparent from the above results in Tables 1 and 2, the photosensitive member prepared in Example 1 provided a high photosensitivity similar to that of the photosensitive member of Comparative Example 1 in spite of a smaller amount of TiOPc and also provided improvements in potential stability and black spots. The photosensitive member of Comparative Example 2 provided an improvement in black spots due to the TiOPc content smaller than that of the photosensitive member of Comparative Example 1 but provided a lower photosensitivity and a slight improvement in potential stability. The photosensitive member of Comparative Example 3 containing the disazo pigment different from that of the present invention failed to bring about improvements as given by the photosensitive member of Example 1 according to the present invention.

EXAMPLE 2

A coating liquid for a first charge generation layer was prepared in the same manner as in Example 1 except for using 10 parts of I-type TiOPc instead of 6 parts of I-type TiOPc and 4 parts of the disazo pigment (Ex. Comp. No. (1)). Separately, a coating liquid for a second charge generation layer was prepared in the same manner as in Example 1 except for using 10 parts of a disazo pigment of the formula (I) (Ex. Comp. No. (5)) instead of 6 parts of I-type TiOPc and 4 parts of the disazo pigment (Ex. Comp. No. (1)).

An electrophotographic photosensitive member was prepared in the same manner as in Example 1 except that the charge generation layer prepared in Example 1 was changed to a lamination-type charge generation layer comprising a 0.1 μm-thick first charge generation layer formed by using the coating liquid therefor (containing the disazo pigment) and a 0.25 μm-thick second charge generation layer formed, on the first charge generation layer by using the coating liquid therefor (containing the TiOPc) and spray coating.

EXAMPLE 3

An electrophotographic photosensitive member was prepared in the same manner as in Example 2 except that the first charge generation layer containing the disazo pigment and the second charge generation layer containing the TiOPc prepared in Example 2 were disposed in reverse order.

Each of the photosensitive members prepared in Examples 2 and 3 was evaluated in the same manner as in Example 1. The results are shown in Table 3.

TABLE 3

| Ex. No. | Sensitivity (μJ/cm$^2$) | Fluctuation in potential $\Delta V_D$ (V) | Fluctuation in potential $\Delta V_L$ (V) | Black spots |
|---|---|---|---|---|
| Ex. | | | | |
| 2 | 0.17 | +5 | −10 | 0 |
| 3 | 0.23 | +5 | +10 | 1 |

As apparent from the above results in Table 3, the photosensitive members including a lamination-type charge generation layer provided improvements in potential stability and black spots. Among them, the photosensitive member of Example 2 in which the first charge generation layer containing the disazo pigment used in the present invention was disposed on the undercoat layer showed better performances.

EXAMPLES 4–6

Electrophotographic photosensitive members were prepared in the same manner as in Example 1 except that the I-type TiOPc was changed to α-type TiOPc (for Example 4) having an X-ray diffraction pattern as shown in FIG. 2, β-type TiOPc (for Example 5) having an X-ray diffraction pattern as shown in FIG. 3, and Y-type TiOPc (for Example 6) having an X-ray diffraction pattern as shown in FIG. 4, respectively.

Comparative Examples 4–6

Electrophotographic photosensitive members were prepared in the same manner as in Comparative Example 1 except that the I-type TiOPc was changed to α-type TiOPc (for Comparative Example 4) β-type TiOPc (for Comparative Example 5), and Y-type TiOPc (for Comparative Example 6), respectively.

Each of the photosensitive members prepared in Examples 4–6 and Comparative Examples 4–6 was evaluated in the same manner as in Example 1. The results are shown in Tables 4 and 5 below.

TABLE 4

| Ex. No. | Crystal form | Weight ratio (TiOPc)/(disazo pigment) | Weight ratio (CGM)/(binder resin) |
|---|---|---|---|
| Ex. | | | |
| 4 | α-type | 6/4 | 10/10 |
| 5 | β-type | 6/4 | 10/10 |
| 6 | Y-type | 6/4 | 10/10 |
| Comp. Ex. | | | |
| 4 | α-type | 10/0 | 10/10 |
| 5 | β-type | 10/0 | 10/10 |
| 6 | Y-type | 10/0 | 10/10 |

TABLE 5

| Ex. No. | Sensitivity (μJ/cm²) | Fluctuation in potential $\Delta V_D$ (V) | Fluctuation in potential $\Delta V_L$ (V) | Black spots |
|---|---|---|---|---|
| Ex. | | | | |
| 4 | 0.37 | −10 | +10 | 2 |
| 5 | 0.36 | −15 | +10 | 2 |
| 6 | 0.26 | −5 | −5 | 2 |
| Comp. Ex. | | | | |
| 4 | 0.36 | −70 | −40 | 5 |
| 5 | 0.34 | −70 | −40 | 5 |
| 6 | 0.24 | −50 | −30 | 5 |

EXAMPLES 7–11

Electrophotographic photosensitive members were prepared and evaluated in the same manner as in Example 1 except that the disazo pigment (Ex. Comp. No. (1)) was changed to those indicated in Table 6 below, respectively. The results are also shown in Table 6.

TABLE 6

| Ex. No. | Ex. Comp. No. | Sensitivity (μJ/cm²) | Fluctuation in potential $\Delta V_D$ (V) | Fluctuation in potential $\Delta V_L$ (V) | Black spots |
|---|---|---|---|---|---|
| Ex. | | | | | |
| 7 | 2 | 0.24 | −15 | −5 | 1 |
| 8 | 3 | 0.25 | −20 | +10 | 1 |
| 9 | 4 | 0.23 | −10 | −10 | 1 |
| 10 | 5 | 0.24 | −15 | +5 | 1 |
| 11 | 6 | 0.22 | −15 | +5 | 0 |

EXAMPLES 12–15

Electrophotographic photosensitive members were prepared and evaluated in the same manner as in Example 1 except that the charge transport material (CTM) was changed to those shown below, respectively. The results are shown in Table 7 appearing hereinafter.

(CTM for Example 12)

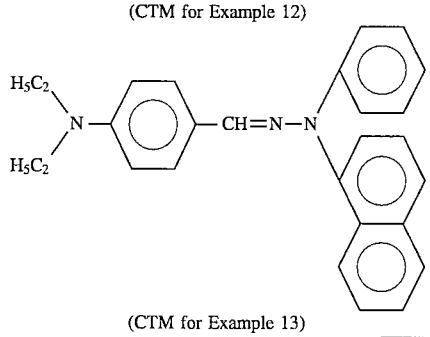

(CTM for Example 13)

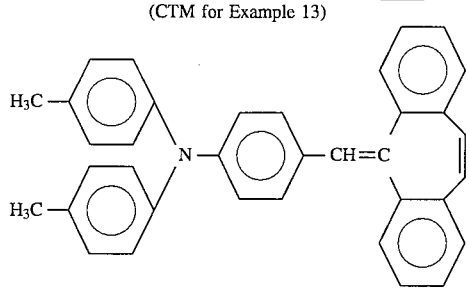

(CTM for Example 14)

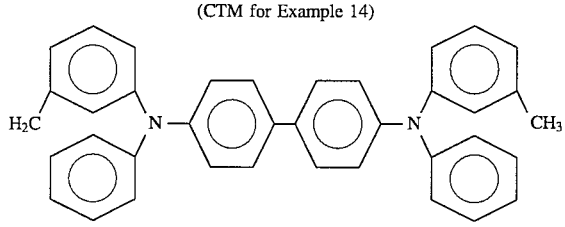

(CTM for Example 15)

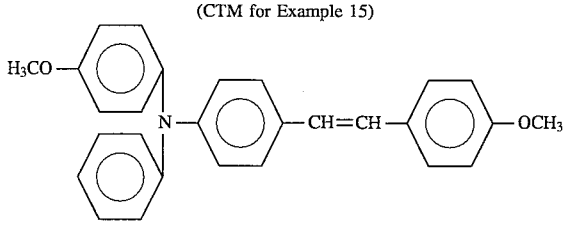

TABLE 7

| Ex. No. | Sensitivity (μJ/cm²) | Fluctuation in potential $\Delta V_D$ (V) | Fluctuation in potential $\Delta V_L$ (V) | Black spots |
|---|---|---|---|---|
| Ex. | | | | |
| 12 | 0.30 | −10 | +10 | 1 |
| 13 | 0.25 | +5 | +10 | 0 |
| 14 | 0.22 | −10 | +5 | 0 |
| 15 | 0.24 | −15 | +10 | 2 |

EXAMPLE 16

An electrophotographic photosensitive member was prepared in the same manner as in Example 1 except that the disazo pigment of the formula (I) (Ex. Comp. No. (1)) was changed to a disazo pigment of the formula (II) (Ex. Comp. No. (7)).

EXAMPLE 17

An electrophotographic photosensitive member was prepared in the same manner as in Example 2 except for using a disazo pigment of the formula (II) (Ex. Comp. No. (7))

instead of the disazo pigment of the formula (I) (Ex. Comp. No. (5)).

EXAMPLE 18

An electrophotographic photosensitive member was prepared in the same manner as in Example 17 except that the first charge generation layer and the second charge generation layer prepared in Example 17 were disposed in reverse order.

Each of the photosensitive member prepared in Examples 16–18 was installed in a laser beam printer ("LBP-SX", mfd. by Canon K. K.) remodeled into one using a direct charging system and evaluated in the same manner as in Example 1 except that the photosensitive member was charged so as to have a dark part potential of −700 V by applying a superposed voltage comprising a DC voltage of −720 V and an AC voltage of 1500 V. The results are shown in Table 8.

TABLE 8

| Ex. No. | Sensitivity ($\mu J/cm^2$) | Fluctuation in potential $\Delta V_D$ (V) | $\Delta V_L$ (V) | Black spots* |
|---|---|---|---|---|
| Ex. | | | | |
| 16 | 0.23 | −10 | 0 | 0 |
| 17 | 0.18 | 0 | −10 | 0 |
| 18 | 0.23 | 0 | +10 | 1 |

EXAMPLES 19–21

Electrophotographic photosensitive members were prepared in the same manner as in Example 1 except that the I-type TiOPc was changed to α-type TiOPc (for Example 19) β-type TiOPc (for Example 20), and Y-type TiOPc (for example 21), respectively.

Each of the photosensitive members prepared in Examples 19–21 was evaluated in the same manner as in Example 16. The results are shown in Tables 9 and 10 below.

TABLE 9

| Ex. No. | Crystal form | Weight ratio (TiOPc)/(disazo pigment) | (CGM)/(binder resin) |
|---|---|---|---|
| Ex. | | | |
| 19 | α-type | 6/4 | 10/10 |
| 20 | β-type | 6/4 | 10/10 |
| 21 | Y-type | 6/4 | 10/10 |

TABLE 10

| Ex. No. | Sensitivity ($\mu J/cm^2$) | Fluctuation in potential $\Delta V_D$ (V) | $\Delta V_L$ (V) | Black spots |
|---|---|---|---|---|
| Ex. | | | | |
| 19 | 0.38 | −20 | +5 | 2 |
| 20 | 0.36 | −25 | +5 | 2 |
| 21 | 0.27 | −15 | −5 | 2 |

EXAMPLES 22–28

Electrophotographic photosensitive members were prepared and evaluated in the same manner as in Example 16 except that the disazo pigment (Ex. Comp. No. (7)) was changed to those indicated in Table 11 below, respectively. The results are also shown in Table 11.

TABLE 11

| Ex. No. | Ex. Comp. No. | Sensitivity ($\mu J/cm^2$) | Fluctuation in potential $\Delta V_D$ (V) | $\Delta V_L$ (V) | Black spots |
|---|---|---|---|---|---|
| Ex. | | | | | |
| 22 | 8 | 0.24 | −15 | −5 | 1 |
| 23 | 9 | 0.25 | −5 | +10 | 1 |
| 24 | 10 | 0.23 | −10 | −10 | 1 |
| 25 | 11 | 0.24 | −15 | +5 | 1 |
| 26 | 12 | 0.22 | −5 | +5 | 0 |
| 27 | 13 | 0.24 | −10 | −10 | 1 |
| 28 | 14 | 0.25 | −15 | −10 | 1 |

EXAMPLE 29

An electrophotographic photosensitive member was prepared and evaluated in the same manner as in Example 1 except that the disazo pigment of the formula (I) (Ex. Comp. No. (1)) was changed to a disazo pigment of the formula (I) (Ex. Comp. No. (15)). The results are shown in Table 12 appearing hereinafter.

EXAMPLE 30

An electrophotographic photosensitive member was prepared in the same manner as in Example 1 except for using a disazo pigment of the formula (I) (Ex. Comp. No. (16)) instead of the disazo pigment of the formula (I) (Ex. Comp. No. (1)).

The photosensitive member was evaluated in the same manner as in Example 16. The results are shown in Table 12.

TABLE 12

| Ex. No. | Sensitivity ($\mu J/cm^2$) | Fluctuation in potential $\Delta V_D$ (V) | $\Delta V_L$ (V) | Black spots |
|---|---|---|---|---|
| Ex. | | | | |
| 29 | 0.24 | +5 | +10 | 1 |
| 30 | 0.25 | −10 | +5 | 1 |

EXAMPLE 31

An electrophotographic photosensitive member was prepared and evaluated in the same manner as in Example 1 except that the disazo pigment of the formula (I) (Ex. Comp. No. (1)) was changed to a disazo pigment of the formula (I) (Ex. Comp. No. (17)). The results are shown in Table 13 appearing hereinafter.

EXAMPLE 32

An electrophotographic photosensitive member was prepared in the same manner as in Example 1 except for using a disazo pigment of the formula (I) (Ex. Comp. No. (18)) instead of the disazo pigment of the formula (I) (Ex. Comp. No. (1)).

The photosensitive member was evaluated in the same manner as in Example 16. The results are shown in Table 13.

TABLE 13

| Ex. No. | Sensitivity ($\mu J/cm^2$) | Fluctuation in potential $\Delta V_D$ (V) | $\Delta V_L$ (V) | Black spots |
|---|---|---|---|---|
| Ex. | | | | |
| 31 | 0.24 | +5 | +15 | 2 |
| 32 | 0.25 | −15 | −5 | 2 |

EXAMPLE 33

A dispersion liquid was prepared by dispersing 0.8 parts of I-type TiOPc, 0.2 part of a disazo pigment of the formula (I) (Ex. Comp. No. (1)), 1.0 part of polyvinyl butyral ("S-LEC BX-1", mfd. by Sekisui Kagaku Kogyo K. K.) and 19 parts of cyclohexanone for 3 hours in a sand mill using 1 mmϕ-glass beads.

Then, to the dispersion liquid, a solution of 10 parts of a charge-transporting material used in Example 1 and 10 parts of a bisphenol Z-type polycarbonate resin in 70 parts of tetrahydrofuran was added to prepare a coating liquid for a photosensitive layer.

An electrophotographic photosensitive member was prepared in the same manner as in Example 1 except that a 25 μm-thick photosensitive layer was formed by applying the above coating liquid onto an undercoat layer, followed by drying for 1 hour at 80° C.

The thus prepared photosensitive member was evaluated in the same manner as in Example 1. The results are shown in Table 14 appearing hereinafter.

Comparative Example 7

An electrophotographic photosensitive member was prepared in the same manner as in Example 33 except for omitting the disazo pigment (Ex. Comp. No. (1)) and evaluated in the same manner as in Example 1. The results are shown in Table 14.

TABLE 14

| Ex. No. | Sensitivity ($\mu J/cm^2$) | Fluctuation in potential $\Delta V_D$ (V) | $\Delta V_L$ (V) | Black spots |
|---|---|---|---|---|
| Ex. 33 | 0.35 | −10 | +15 | 1 |
| Comp. Ex. 7 | 0.40 | −50 | +50 | 3 |

As described hereinabove, by using TiOPc and a disazo pigment of the formula (I) or (II) in combination, it was possible to provide an electrophotographic photosensitive member having excellent stability of electric potential in repetitive use and capable of providing good images substantially free from black spots even under high-temperature and high-humidity environmental condition without impairing a high photosensitive characteristic of TiOPc.

What is claimed is:

1. An electrophotographic photosensitive member, comprising: a support and at least a photosensitive layer disposed on the support, wherein said photosensitive layer comprises oxytitanium phthalocyanine and a disazo pigment represented by the following formula (I):

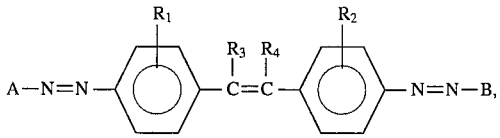

(I)

in which $R_1$ and $R_2$ independently denote hydrogen atom, halogen atom, alkyl group or alkoxy group;

$R_3$ and $R_4$ independently denote hydrogen atom, halogen atom or cyano group; and A and B independently denote a coupler residue represented by the following group (i) or (ii):

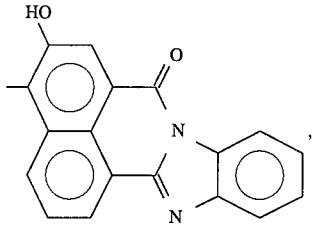

(i)

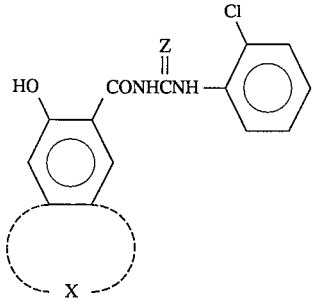

(ii)

wherein X denotes a residual group for forming a substituted or unsubstituted polycyclic aromatic group or a substituted or unsubstituted polycyclic heterocycle through condensation reaction with benzene ring; and Z denotes oxygen atom or sulfur atom.

2. An electrophotographic photosensitive member, comprising: a support and at least a photosensitive layer disposed on the support, wherein said photosensitive layer comprises oxytitanium phthalocyanine and a disazo pigment represented by the following formula (II):

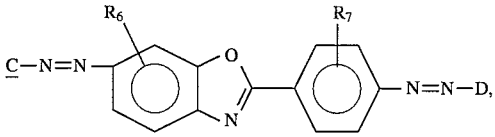

(II)

in which $R_6$ and $R_7$ independently denote hydrogen atom, halogen atom, alkyl group or alkoxy group; and C and D independently denote a coupler residue represented by any one of the following group (i) or (v):

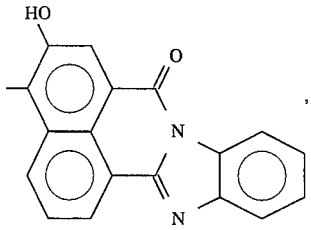

(i)

-continued or

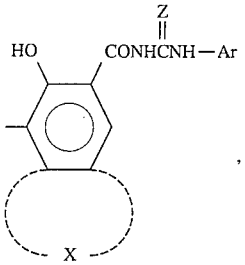

(v)

wherein X denotes a residual group for forming a substituted or unsubstituted polycyclic aromatic ring or a substituted or unsubstituted polycyclic heterocycle through condensation reaction with benzene ring; Z denotes oxygen atom or sulfur atom; and Ar denotes substituted or unsubstituted aryl group.

3. A member according to claim 1 or 2, wherein said oxytitanium phthalocyanine has a crystal form characterized by main peaks specified by Bragg angles (2θ±0.2 degree) of 9.0 degrees, 14.2 degrees, 23.9 degrees and 27.1 degrees in X-ray diffraction pattern based on CuKα characteristic X-rays.

4. A member according to claim 1 or 2, wherein said oxytitanium phthalocyanine has a crystal form characterized by main peaks specified by Bragg angles (2θ±0.2 degrees) of 7.6 degrees and 28.6 degrees in X-ray diffraction pattern based on CuKα characteristic X-rays.

5. A member according to claim 1 or 2, wherein said oxytitanium phthalocyanine has a crystal form characterized by main peaks specified by Bragg angles (2θ±0.2 degree) of 9.3 degrees and 26.3 degrees in X-ray diffraction pattern based on CuKα characteristic X-rays.

6. A member according to claim 1 or 2, wherein said oxytitanium phthalocyanine has a crystal form characterized by main peaks specified by Bragg angles (2θ±0.2 degrees) of 9.5 degrees and 27.3 degrees in X-ray diffraction pattern based on CuKα characteristic X-rays.

7. A member according to claim 1, wherein said photosensitive layer comprises at least a charge generation layer and a charge transport layer in lamination, said charge generation layer comprising said oxytitanium phthalocyanine and said disazo pigment of the formula (I).

8. A member according to claim 7, wherein said charge generation layer has a single layer structure.

9. A member according to claim 7, wherein said charge generation layer has a lamination structure including a first charge generation layer comprising said disazo pigment of the formula (I) and a second charge generation layer comprising said oxytitanium phthalocyanine.

10. A member according to claim 7, wherein said charge generation layer has a lamination structure including a first charge generation layer comprising said disazo pigment of the formula (I) and a second charge generation layer comprising said oxytitanium phthalocyanine, said second charge generation layer being in contact with said charge transport layer.

11. A member according to claim 7, wherein said charge generation layer has a lamination structure including a first charge generation layer comprising said disazo pigment of the formula (I) and a second charge generation layer comprising said oxytitanium phthalocyanine, said first charge generation layer being in contact with said charge transport layer.

12. A member according to claim 2, wherein said photosensitive layer comprises at least a charge generation layer and a charge transport layer in lamination, said charge generation layer comprising said oxytitanium phthalocyanine and said disazo pigment of the formula (II).

13. A member according to claim 12, wherein said charge generation layer has a single layer structure.

14. A member according to claim 12, wherein said charge generation layer has a lamination structure including a first charge generation layer comprising said disazo pigment of the formula (II) and a second charge generation layer comprising said oxytitanium phthalocyanine.

15. A member according to claim 12, wherein said charge generation layer has a lamination structure including a first charge generation layer comprising said disazo pigment of the formula (II) and a second charge generation layer comprising said oxytitanium phthalocyanine, said second charge generation layer being in contact with said charge transport layer.

16. A member according to claim 12, wherein said charge generation layer has a lamination structure including a first charge generation layer comprising said disazo pigment of the formula (II) and a second charge generation layer comprising said oxytitanium phthalocyanine, said first charge generation layer being in contact with said charge transport layer.

17. An electrophotographic apparatus, comprising: an electrophotographic photosensitive member according to claim 1 or 2, a charging means for charging the electrophotographic photosensitive member, an image-exposure means for effecting image-exposure to the electrophotographic photosensitive member to form an electrostatic latent image, and a developing means for developing the electrostatic latent image with a toner.

18. An apparatus according to claim 17, wherein said charging means comprises a direct charging member.

19. An electrophotographic apparatus unit, comprising: an electrophotographic photosensitive member according to claim 1 or 2 and a direct charging member contacting and charging the electrophotographic photosensitive member.

20. A unit according to claim 19, which further comprises a developing means for developing an electrostatic latent image formed on the electrophotographic photosensitive member.

* * * * *